US005149153A

United States Patent [19]

Drewry et al.

[11] Patent Number: 5,149,153

[45] Date of Patent: Sep. 22, 1992

[54] SELF-DISENGAGING LOCKING DEVICE

[76] Inventors: Thomas L. Drewry, Rte. 4, Box 1105, Union City, Tenn. 38261; Max L. Hardin, Rte. 1, Kenton, Tenn. 38233

[21] Appl. No.: 842,266

[22] Filed: Feb. 27, 1992

Related U.S. Application Data

[63] Continuation-in-part of Ser. No. 691,520, Apr. 25, 1991, Pat. No. 5,094,487.

[51] Int. Cl.[5] ..... B65F 1/12; F05C 1/08

[52] U.S. Cl. ..... 292/104; 220/908; 292/184; 292/148; 292/341.15

[58] Field of Search ..... 220/908; 414/414; 294/68.26; 292/235, 237, 131, 135, 341.15, 104, 183, 184, 148

[56] References Cited

U.S. PATENT DOCUMENTS

| | | | |
|---|---|---|---|
| 4,155,584 | 5/1979 | Pracenia | 414/414 |
| 4,182,530 | 1/1980 | Hodge | 220/908 |
| 5,015,021 | 5/1991 | Wyson et al. | 292/230 |
| 5,042,856 | 8/1991 | Goodman | 292/237 |
| 5,085,341 | 2/1992 | Hodge | 220/908 |
| 5,090,753 | 2/1992 | Goodman | 292/230 |
| 5,094,358 | 3/1992 | Serio, Sr. | 220/908 |

FOREIGN PATENT DOCUMENTS 858652 12/1952 Fed. Rep. of Germany ..... 292/237

*Primary Examiner*—Eric K. Nicholson

*Attorney, Agent, or Firm*—Heiskell, Donelson, Bearman, Adams, Williams & Kirsch

[57] ABSTRACT

An automatically disengaging locking device is provided for use on a container having a hinged lid pivotable between open and closed positions. The locking device consists of a housing mounted to the side surface of the container, and a latch securable to the lid having a portion which extends through an opening in the housing when the lid is closed. The locking device further includes a keeper element disposed within the housing for engaging the lower portion of the latch to secure the lid in its closed position, a manual release mechanism comprising a plunger for allowing the selective disengagement of the keeper from the latch, and an automatic release mechanism operative to disengage the keeper from the latch when the container is moved for emptying. IN a first embodiment the automatic release mechanism comprises a pendulum, and in a second embodiment the automatic release mechanism comprises a rolling keeper pin.

14 Claims, 6 Drawing Sheets

SELF-DISENGAGING LOCKING DEVICE

This is a continuation-in-part application of co-pending application Ser. No. 07/691,520 filed Apr. 25, 1991, and priority is hereby claimed under 35 U.S.C. 120 and 37 CFR 1.78.

BACKGROUND OF THE INVENTION

1. Field

The present invention relates to locking devices for use on containers having hinged lids, and, more particularly, to such locking devices which automatically become disengaged in order to allow emptying of the containers.

2. Description of the Prior Art

Large generally rectangular containers having hinged lids are commonly used for purposes of trash collection, particularly by businesses and apartment complexes. These containers are commonly referred to as "dumpsters". In order to open the lid to deposit refuse in such a container, one must simply lift the front portion of the lid to a sufficient degree. Typically, emptying of such a container is accomplished by a large, specially equipped truck, which has means for lifting and inverting the container, thereby allowing the lid to swing open and the contents to fall into a large bin located within the body of the truck.

Frequently, unauthorized persons not associated with the owner or rightful user of such containers will utilize the containers for their garbage disposal. This has resulted in a considerable problem, in that the containers often times become completely filled with the garbage of such unauthorized persons, leaving no room for the garbage of those persons paying for the container and related collection services. This problem has become particularly severe for rural apartment complexes, since their trash containers are often used by persons living in outlying areas who find the containers to be more convenient than a local landfill. As a result, apartment owners frequently are forced to pay for an additional pick-up to make room for their tenants' garbage.

Many trash containers include provisions for utilizing a locking device, such as a padlock, to prevent the lid from being opened by anyone not having the proper key, combination, or other unlocking means. When such locking devices are utilized, it is essential that the locking device be removed or otherwise disengaged prior to the arrival of the collection truck to allow emptying. Since it is usually difficult or impossible to precisely predict the arrival of the collection truck, the use of such locking devices has proven to be inadequate. Accordingly, a need has developed for a self-disengaging locking device which allows selective access to the trash container, but need not be attended to for purposes of dumping.

Most dumpsters have either a single, large lid, or a pair of smaller lids covering the opening therein. The double-lid configuration is particularly common for plastic containers. A need has been recognized for a self-disengaging locking device which is adapted for use on both single-lid and double-lid containers, and which is operative to secure both lids of a double-lid container.

BRIEF SUMMARY OF THE INVENTION

It is an object of the present invention to alleviate the problems associated with conventional locking devices by providing a relatively inexpensive and simple device which automatically disengages itself when necessary for dumping. It is also an object of this invention to provide a locking device which can be maintained in either a completely unlocked state or in a locked state to allow access only to certain authorized persons. It is a further object of this invention to provide a self-disengaging locking device which can be operatively installed on either a single-lid container, or on both lids of a double-lid container.

In accordance with the teachings of the present invention, there is disclosed herein a preferred embodiment of a locking device having a latch member securable to the lid of a trash receptacle or similar- container, and a keeper mounted within a housing on the side of the receptacle. The latch and housing are aligned such that, upon closure of the receptacle lid, a portion of the latch enters the housing through an opening in the top surface thereof and engages the keeper. Manual release means are provided to allow the user of the dumpster to disengage the keeper from the latch in order to raise the lid for depositing refuse within the container. The manual release mechanism is adapted to receive a lock, such as a padlock, to prevent its operation by unauthorized persons. Finally, the keeper consists of a pendulum, wherein the upper portion is configured for engagement with a latch and the lower portion is weighted to maintain the pendulum in an upright position, so that tilting of the container for dumping operates to disengage the keeper from the latch.

In another embodiment of this invention, the keeper consists of a bar disposed within the housing such that, when the container is in an upright position the bar engages the latch, but when the container is tilted for dumping the bar rolls or slides out of engagement with the latch. With this embodiment, the housing is preferably mounted on the front of the container, rather than the side, making this embodiment particularly well adapted for securing both lids of a double-lid container.

These and other objects of the present invention will become apparent from the reading of the following specification, taken in conjunction with the enclosed drawings.

DETAILED DESCRIPTION OF THE PREFERRED EMBODIMENT

Figure 1:
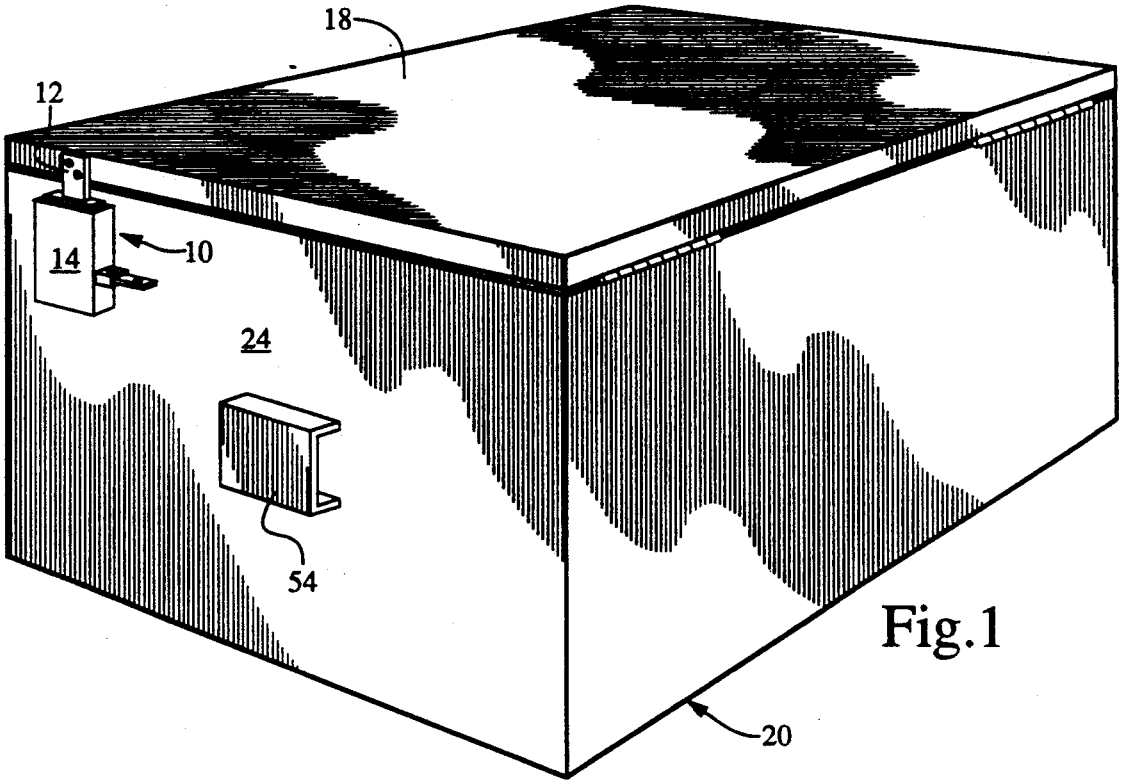
FIG. 1 is a perspective view of a typical container having the preferred locking device of the present invention operatively mounted thereon.
Figure 2:
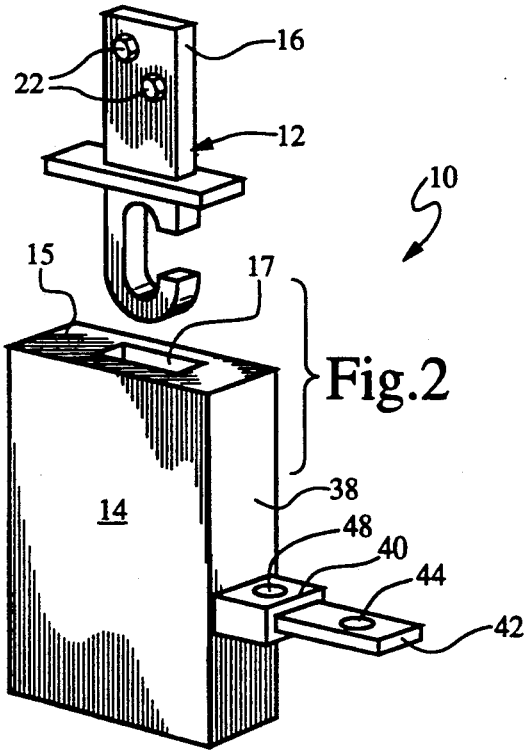
FIG. 2 is a partially exploded perspective view of the present invention.

Referring initially to FIG. 2, the preferred embodiment of locking device 10 is shown to include two main components, latch 12 and housing 14. The upper portion 16 of latch 12 includes provisions for securing latch 12 to the hinged lid 18 of a conventional refuse container 20 as shown in FIG. 1. In the embodiment shown, these provisions comprise screws 22, but it is expected that other attachment means such as riveting, welding, etc. could also be suitable for the purposes described herein. Housing 14 is similarly secured to side portion 24 of refuse container by screws (not shown) or other suitable means. The upper surface 15 of housing 14 includes a slot 17 formed therethrough for receiving hook 36 of latch 12.

Figure 3:
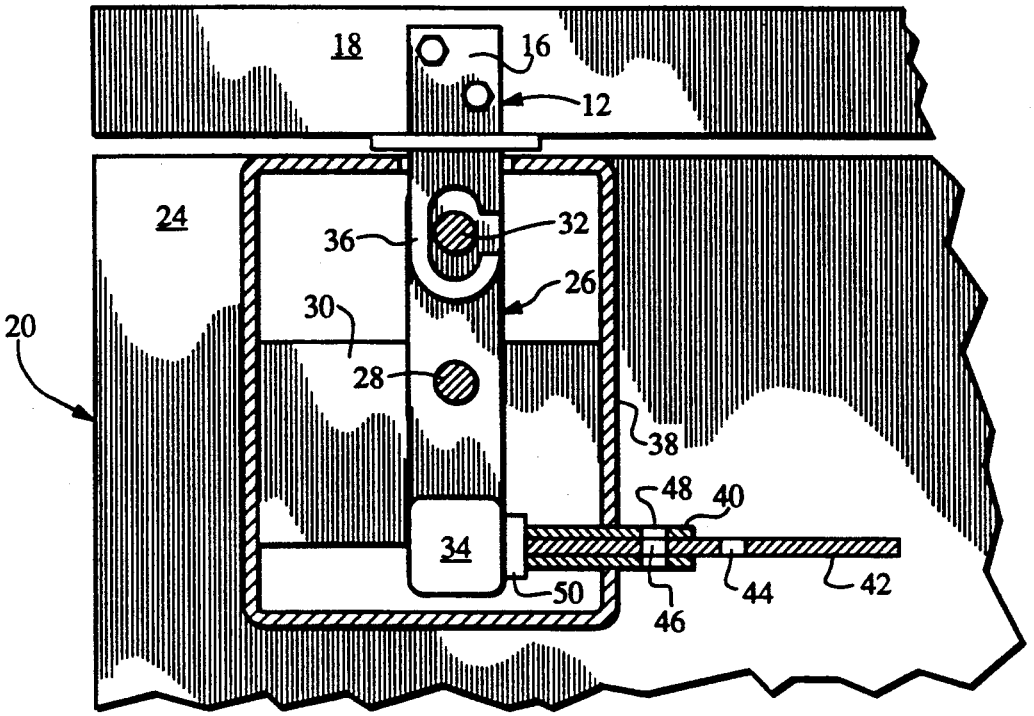
FIG. 3 is a front sectional view of the present invention, showing the keeper and latch in their engaged positions.
Figure 4:
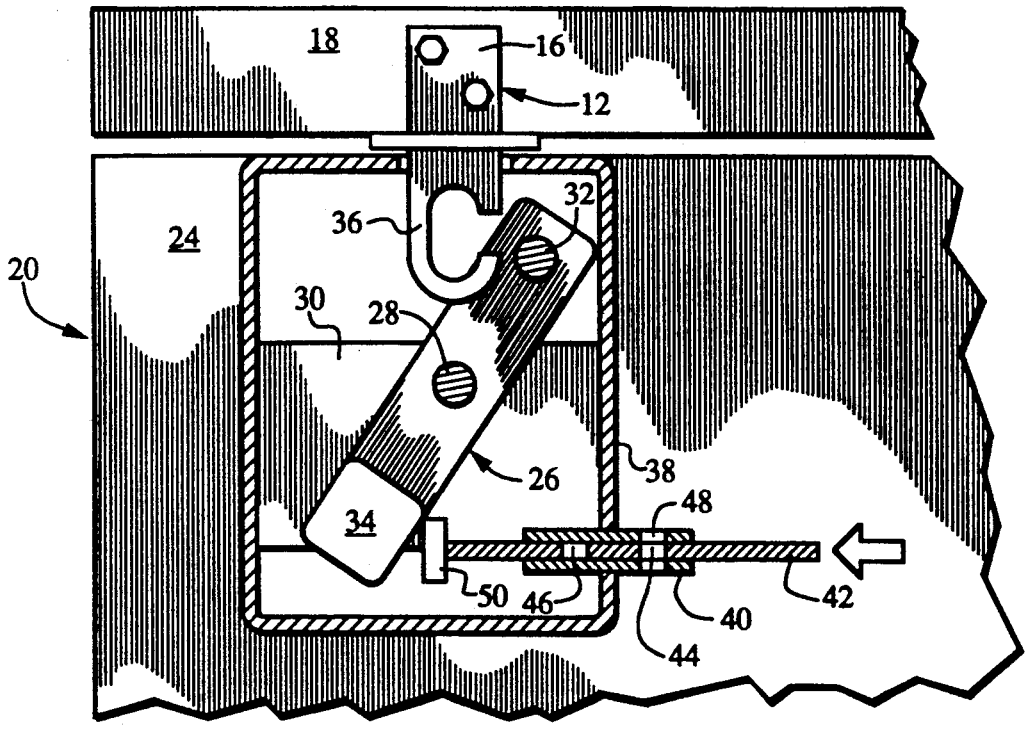
FIG. 4 is a front sectional view of the present invention, showing the manual release means in its depressed position and the keeper disengaged from the latch.

Pivotally mounted within housing 14 is keeper 26, as best shown in FIGS. 3 and 4. Keeper 26 preferably includes generally central post 28, which extends laterally between internal member 30 and the exterior wall of housing 14 and is rotatably mounted therebetween. The upper portion of keeper 26 includes a laterally extending finger 32, while the lower portion of keeper 26 comprises a weighted member 34. As shown in FIG. 3, finger 32 is positioned and adapted to be received and retained by lower hook portion 36 of latch 12. Member 34 is sufficiently heavy so that keeper 26 operates as a pendulum to maintain its generally upright position upon rotation of housing 14, as discussed more fully below.

Side 38 of housing 14 has generally rectangular passageway formed therein defined by duct 40. Slidably disposed within duct 40 is plunger 42, which includes two vertical holes 44 and 46. Duct 40 also includes a vertical hole 48, alignable with either hole 44 or 46 of plunger 42 for reasons discussed below. End portion 50 of plunger 42 abuts weighted member 34 of keeper 26.

Figure 5:
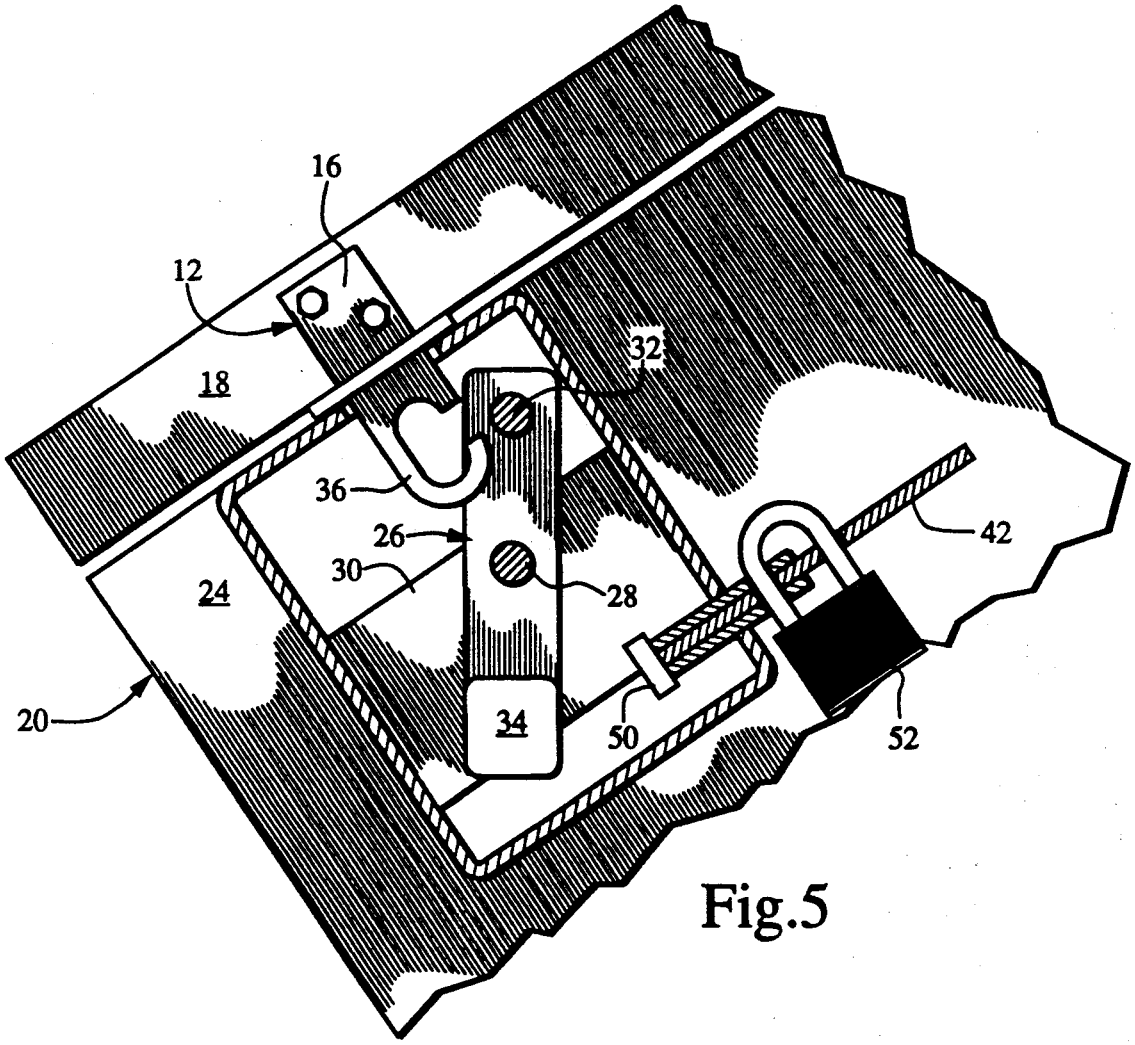
FIG. 5 is a front sectional view of the present invention, showing the automatic disengagement of the keeper from the catch upon tilting of the container.

With refuse container 20 in its normal, upright storage position as shown in FIG. 1, plunger 42 is typically maintained in its extended position as illustrated in FIG. 3. With plunger 42 in the extended position, finger 32 of keeper 26 is engaged with hook 36 of latch 12, thereby preventing the opening of lid 18. When the owner or other authorized user of refuse container 20 desires to dispose of trash, plunger 42 may be moved to its depressed position, as shown in FIG. 4, whereby end portion 50 drives weighted member 34 in a manner causing rotation of keeper 26 and consequent disengagement of finger 32 from hook 36 of latch 12. With plunger 42 held in the depressed position, lid 18 of refuse container 20 may be opened and closed as desired. In order to prevent the unauthorized usage of refuse container 20, padlock 52 may be secured through hole 48 of duct 40 and hole 46 of plunger 42 as shown in FIG. 5, padlock 52 being operative to prevent the lateral movement of plunger 42. With padlock 52 so disposed, only those persons having the key or combination to padlock 52 are provided access to refuse container 20. Alternatively, hole 44 of plunger 42 may be aligned with hole 48 and padlock 52 disposed therethrough, thereby maintaining plunger 42 in its depressed position to provide uninhibited access to refuse container 20.

As those skilled in the art will fully understand, refuse containers are typically emptied by collection vehicles having means for lifting and tilting such containers in a manner allowing the hinged lid to swing open and the contents fall out, relying primarily on the force of gravity. As shown in FIG. 1, refuse container 20 has a lifting member 54 disposed on each side thereof for this purpose. During the tilting of refuse container 20, weighted portion 34 tends to maintain keeper 26 in a generally upright or vertical position, thereby causing rotational movement of keeper 26 relative to latch 12, as illustrated in FIG. 5. Such relative rotational movement results in the disengagement of finger 32 from hook 36 of latch 12, the same as if plunger 42 had been moved to its depressed position. Accordingly, upon tilting of refuse container 20 to a sufficient degree, keeper 26 disengages latch 12 thereby allowing lid 18 to swing open and the trash to fall out of refuse container 20, without requiring the removal of padlock 52 and operation of plunger 42.

Referring now to FIGS. 6–16, an alternative embodiment of this invention is disclosed, comprising locking device 110 operatively attached to container 120. As shown, container 120 is a double-lid container, and locking device 110 is specially adapted for attachment to the front of container 120 and for simultaneously engaging both lids thereon. It will be readily apparent from this disclosure, however, that locking device 110 could easily be adapted for attachment to the side of container 120, thereby securing only one lid in the same general manner as locking device 10 described above.

Figure 6:
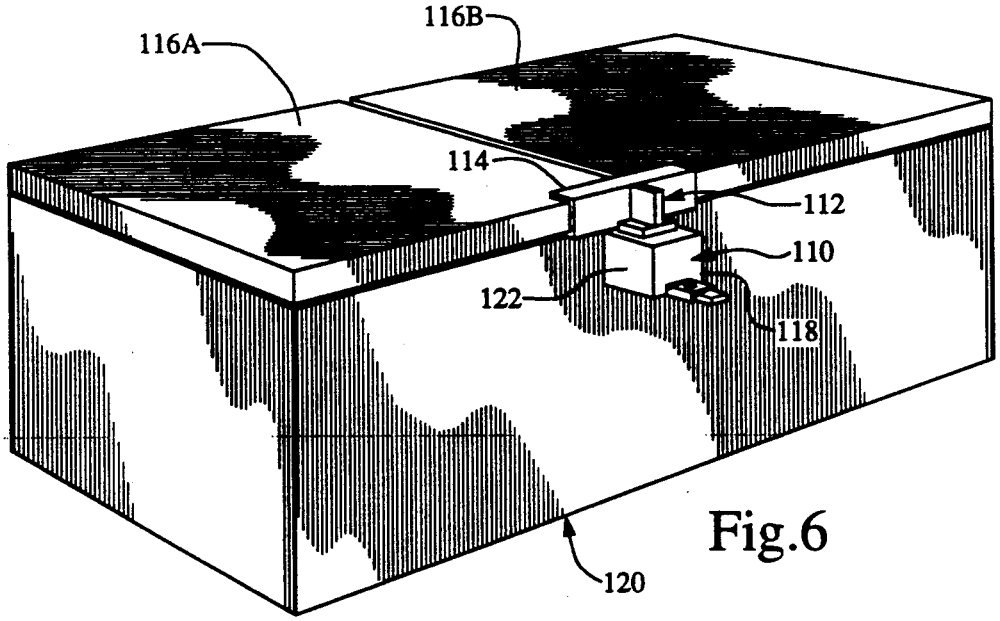
FIG. 6 is a front perspective view of a double-lid container having an alternative embodiment of this invention mounted thereon.

Referring initially to FIG. 6, locking device 110 comprises latch 112 secured to channel member 114, with channel member 114 being rigidly secured to front corner portions of hinged lids 116A and 116B. Locking device 110 further comprises a receptacle 118, having an outer housing 122 with a slot 146 formed therethrough for receiving latch 112 as discussed more fully below, and an inner housing 124. For the sake of convenience and clarity of illustration, outer housing 122 has been omitted from FIGS. 7–12 from this disclosure, however, the structure and function of outer housing 122 will be readily apparent to those skilled in the art.

Referring now to FIGS. 7–10, front wall 126 of inner housing 124 is shown having rectangularly-shaped tubular member 128 rigidly secured thereto and forming a passageway therethrough, in a similar manner as duct 40 of locking device 10 discussed above. Plunger 130 is slidably disposed within tubular member 128, with end 132 extending therefrom for grasping by the user of locking device 110.

Figure 7:
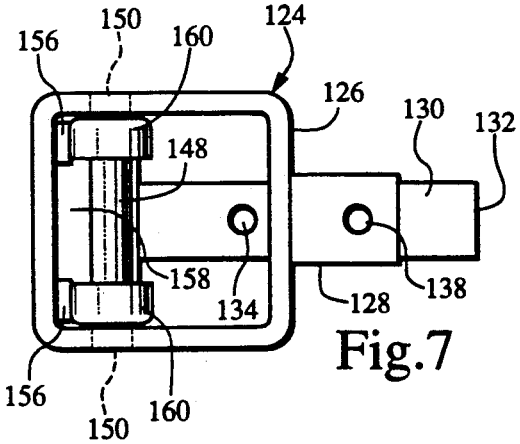
FIG. 7 is a top plan view of the alternative embodiment of this invention, with the outer housing removed.
Figure 8:
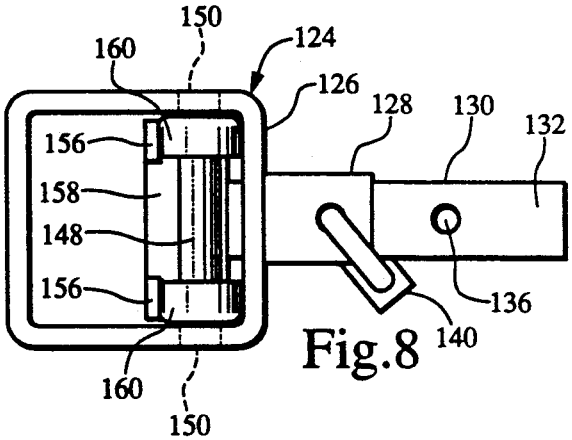
FIG. 8 is a bottom plan view of the alternative embodiment of this invention, with the outer housing removed.
Figure 9:
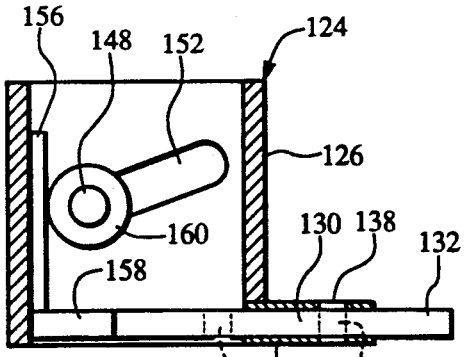
FIG. 9 is a side sectional view of the receptacle portion of the alternative embodiment of this invention, with the plunger in its depressed position.
Figure 10:
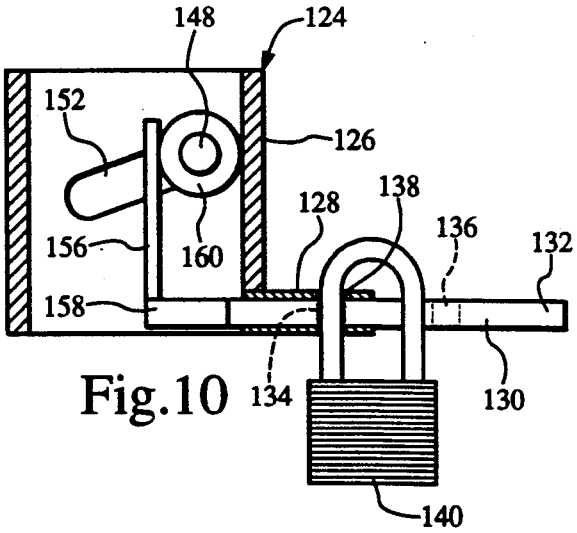
FIG. 10 is a side sectional view similar to FIG. 9, with the plunger in its locked extended position.
Figure 11:
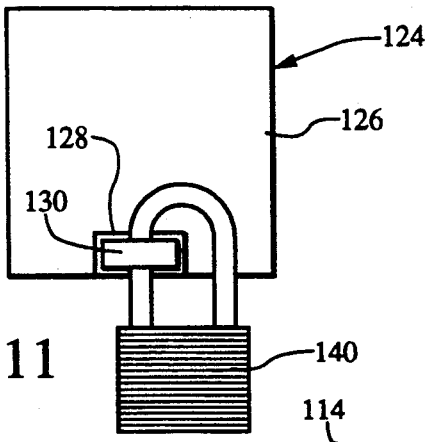
FIG. 11 is a front elevational view of the receptacle portion of the alternative embodiment of this invention.
Figure 12:
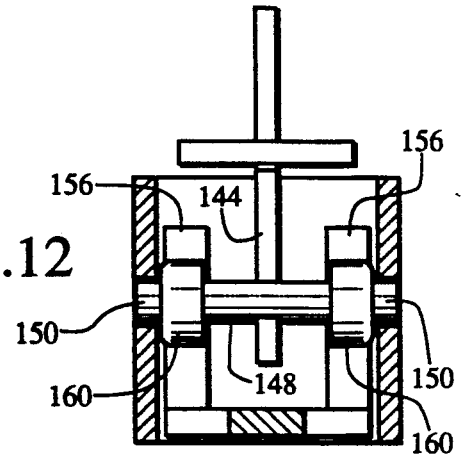
FIG. 12 is a front view of the alternative embodiment, with the keeper and latch engaged and the outer housing shown in section.

Holes 134 and 136 are formed through plunger 130, transverse to the longitudinal axis of plunger 130. Similarly, hole 138 is formed through tubular member 128. Depending upon the precise configuration of plunger 130, it may be desirable to orient holes 134, 136, and 138 horizontally, rather than vertically as shown. Plunger 130 is selectively movable between a depressed position, as shown in FIGS. 7 and 9, wherein holes 138 and 136 are coaxially aligned. Plunger 130 is also movable to an extended position, as shown in FIGS. 8 and 10, wherein hole 138 is coaxially aligned with hole 134. Padlock 140 may be operatively disposed through the aligned combination of holes 136 and 138, thereby serving as a locking means to maintain plunger 130 in its depressed position. Alternatively, padlock 140 may be operatively disposed through aligned holes 134 and 138, thereby maintaining plunger 130 in its extended position. The elimination of padlock 140 allows the user of locking device 110 to selectively move plunger 130 from its depressed position to its extended position as desired. The reasons for moving plunger 130 between its extended and depressed positions will be evident from the following description.

Figure 13:
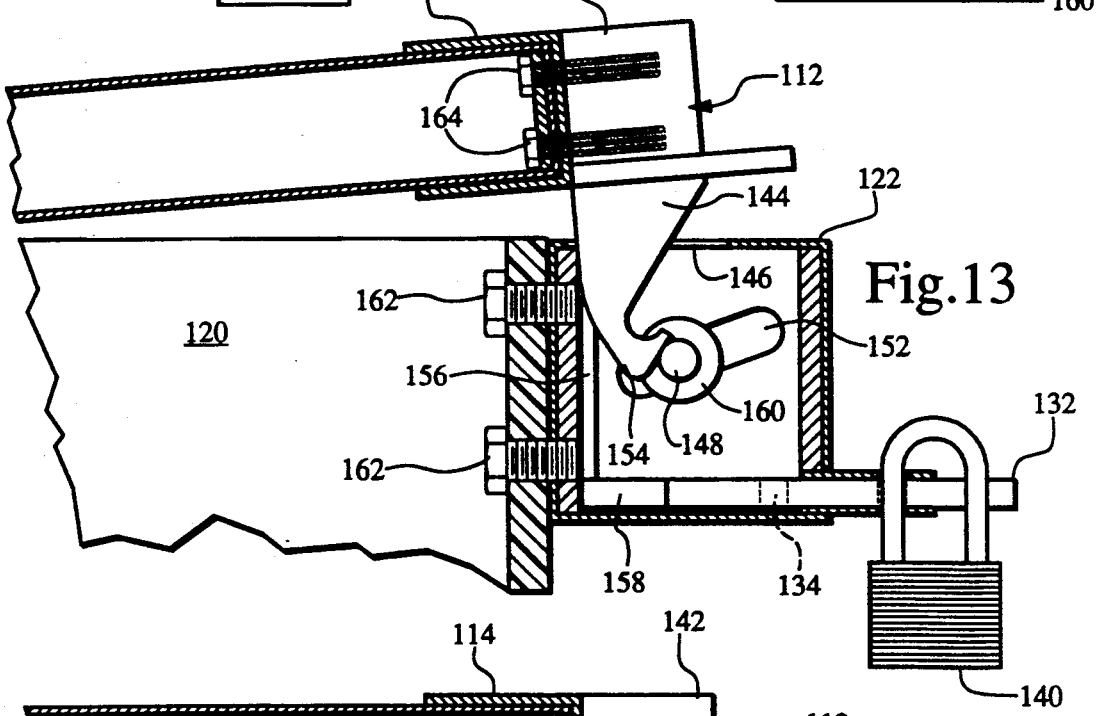
FIG. 13 is a side sectional view of the alternative embodiment installed on a container, showing the container in a closing position.
Figure 14:
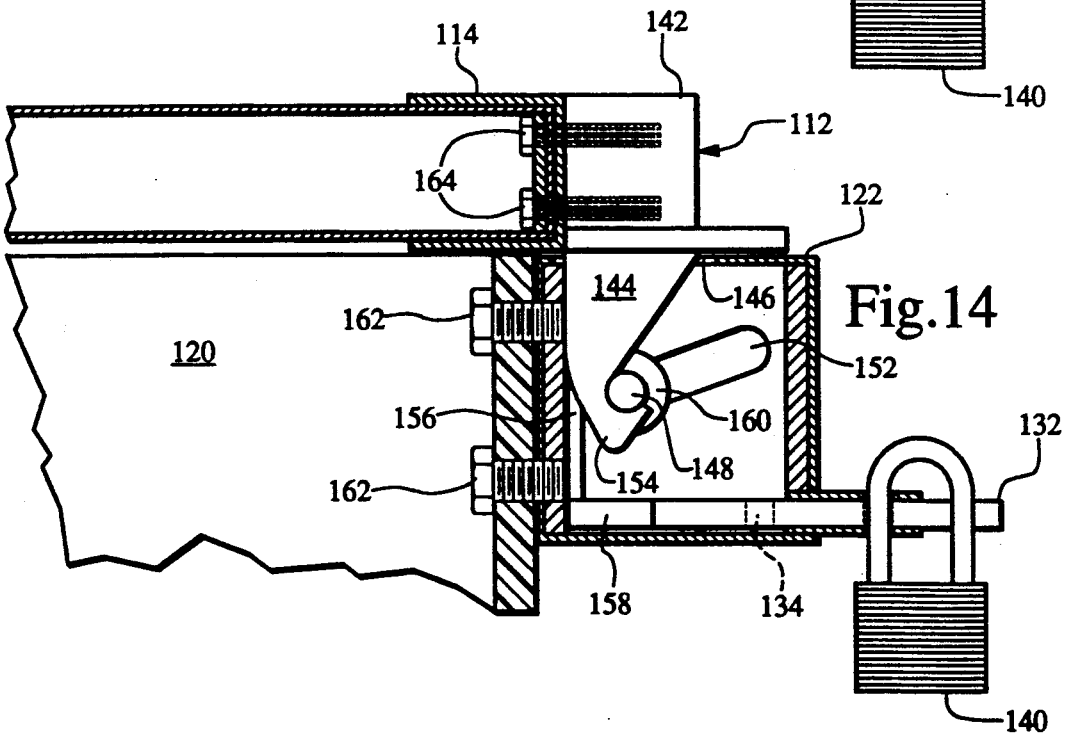
FIG. 14 is a side sectional view of the alternative embodiment similar to FIG. 13, showing the container in its closed position with the latch engaged with the keeper.

Referring now to FIGS. 13 and 14, latch 112 is shown having an upper portion 142 rigidly secured to channel member 114, with lower portion 144 extending downwardly for insertion through opening 146 in outer housing 122. Keeper pin 148 is horizontally disposed within inner housing 124, having opposite end portions 150 slidably disposed within slots 152 formed within the opposite sides of inner housing 124. Hooked-shaped end 154 of latch 112 is configured so that the front portion thereof pushes keeper pin 148 slightly forward during closure of lids 116A and 116B. Upon complete closure of lids 116A and 116B, keeper pin 148 slides or rolls into proper engagement with end 154, thereby securing lids 116A and 116B in their closed position, as illustrated in FIG. 14.

Referring once again to FIGS. 7–10, fingers 156 extend vertically from end 158 of plunger 130, and bear upon members 160 of keeper pin 148. With plunger 130 in its depressed position, keeper pin 148 is suitably disposed for automatic engagement with end 154 of latch 112 as shown in FIGS. 13 and 14. Upon movement of plunger 130 to its extended position, fingers 156 pull keeper pin 148 forward and upward, as guided by slots 152, thereby disengaging keeper pin 148 from end 154. By holding plunger 130 in its extended position, or by installing padlock 140 through holes 134 and 138 as shown in FIG. 10, locking device 110 may be maintained indefinitely in a disengaged condition. Alternatively, by installing padlock 140 through holes 136 and 138 as shown in FIGS. 13 and 14, locking device 110 is maintained in its automatically engaged condition, so that container 120 is accessable only to those authorized persons having the means (either a key or combination) to unlock padlock 140.

Figure 15:
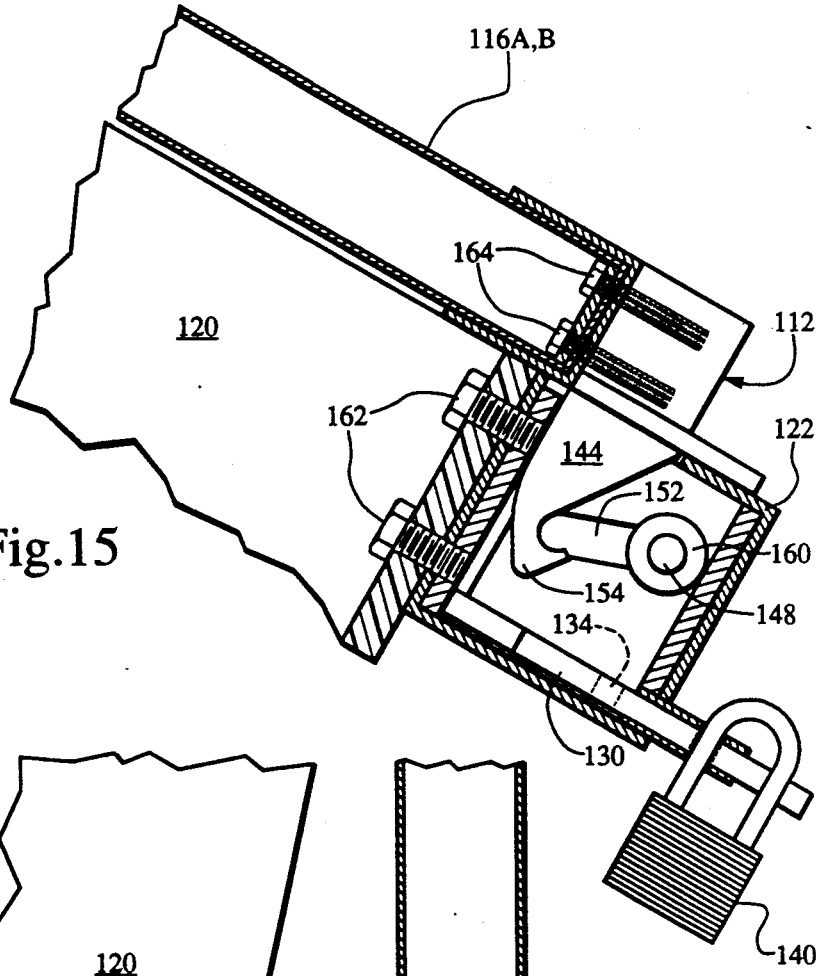
FIG. 15 is a side sectional view of the alternative embodiment similar to FIGS. 13 and 14, showing the container being tilted to disengage the keeper from the latch.
Figure 16:
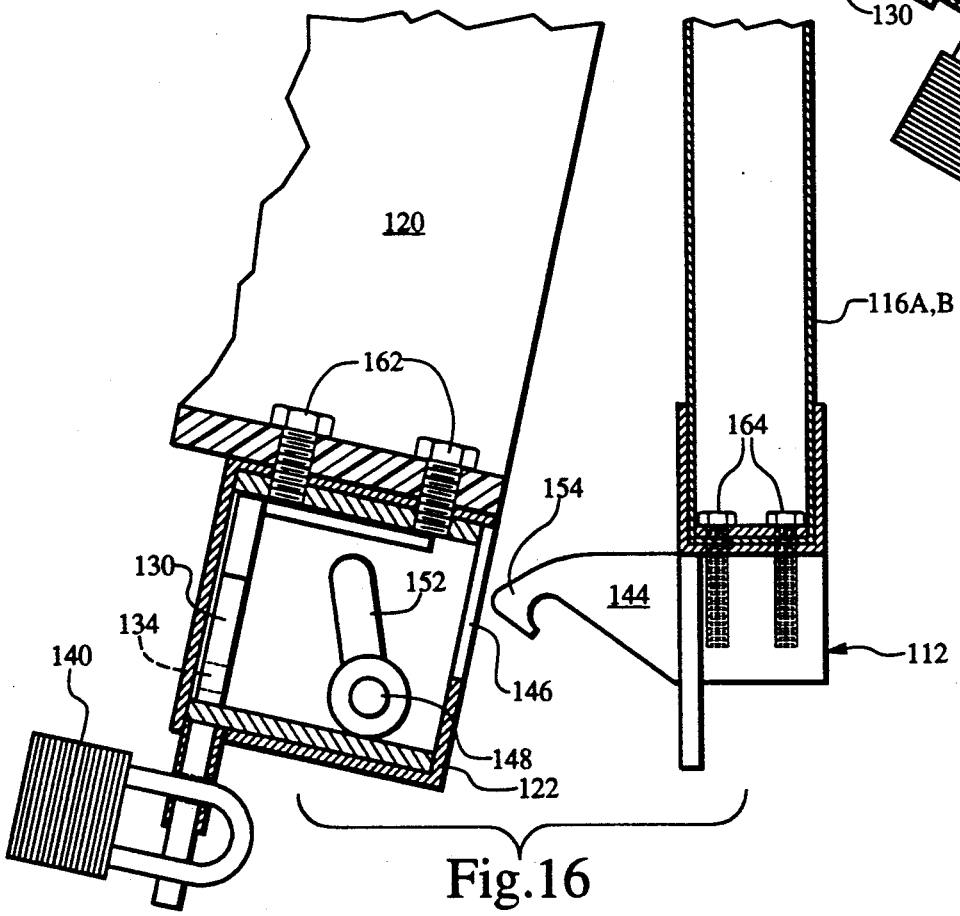
FIG. 16 is a side sectional view of the alternative embodiment similar to FIGS. 13, 14, and 15, showing the container in a tilted position suitable for dumping.

Upon tilting container 120 for dumping or emptying, as shown in FIGS. 15 and 16, keeper pin 148, by its own weight, rolls or slides forward along slots 152, thereby automatically disengaging itself from end 154 of latch 112. Lids 116A and 116B are then free to swing open upon further tilting of container 120, thereby enabling the trash or other contents of container 120 to exit.

Locking device 110 is shown as being secured to the front portion of container 120, with screws 162 securing receptacle 118 and screws 164 securing latch 112. Those skilled in the art will readily understand, however, that any suitable attachment means may be employed for purposes of this invention, and that locking device 110 may be attached to the side of container 120 without departing from the spirit and scope of this invention. It will also be readily understood that, while locking device 110 is shown as being particularly well suited for dual lid containers, the principles of this invention are equally applicable to single lid containers.

The materials of construction utilized for locking device 10 are generally non-critical for purposes of this invention. Steel, aluminum, or any other material of suitable strength and cost effectiveness may be employed. It may also be preferable to form keeper pin 148 and keeper 26, or at least weighted member 34, from a non-magnetic material to prevent unauthorized access to containers 20 or 120 through the use of a magnet to disengage locking devices 10 or 110. It is also foreseen that padlocks 52 and 140 could be replaced by a locking device wholly contained within housing 14 or housing 122, respectively. However, the embodiments disclosed herein are considered to be preferable for purposes of simplicity, reliability, and cost.

While the principal of providing an automatically disengaging locking device for a refuse container has been made clear, it will be immediately apparent to those skilled in the art that there are many possible modifications to the disclosed embodiment without departing from the basic spirit of the present invention. Accordingly, the following claims are intended to cover and embrace not only the specific embodiment disclosed herein, but also such modifications within the spirit and scope of this invention.

What is claimed is:

1. A locking device for use on a container having at least one hinged lid pivotable between open and closed positions and generally vertical front and side walls, said locking device comprising:

a housing, having an opening formed therein, mounted to a wall of said container;

latch means, having a first portion securable to the lid of said container and a second portion extendable through said opening when said lid is in its closed position;

keeper means, disposed within said housing, for engaging said second portion of said latch means upon moving said lid to its closed position, thereby securing said lid in its closed position, said keeper means comprising a keeper pin having first and second ends slidably disposed within said housing, said keeper pin being moveable between engaged and disengaged positions relative to said second portion of said latch means; and manual release means, operative for selectively moving said keeper pin between said engaged and disengaged positions, thereby allowing selective opening of said lid.

2. A locking device as set forth in claim 1, further comprising locking means for preventing the operation of said manual release means.

3. A locking device as set forth in claim 1, wherein:

said first and second ends of said keeper pin are slidably disposed within internal slots formed in said housing, whereby upon tilting said container for dumping, said keeper pin moves under its own weight from said engaged position to said disengaged position, thereby allowing opening of said at least one lid, said first and second ends of said keeper pin being supported within said slots.

4. A locking device as set forth in claim 1, wherein said manual release means comprise a plunger slidably disposed within a tubular member extending horizontally from a front portion of said housing, said plunger having:

a first end having at least one finger extending therefrom said at least one finger bearing on said keeper pin, and a second end extending horizontally from said front portion of said housing, said plunger being selectively movable between a first position and a second position, whereby moving said plunger from said first position to said second position causes said fingers to move said keeper pin to its disengaged position.

5. A locking device as set forth in claim 4, further comprising locking means to prevent operation of said manual release means, said locking means comprising:

a first hole formed through said plunger;

a second hole formed through said tubular member, said second hole being aligned with said first hole when said plunger is in said first position; and a padlock, disposable through said holes to prevent unauthorized movement of said plunger to said second position.

6. A. locking device as set forth in claim 5, further comprising a third hole, formed through said plunger and aligned with said second hole when said plunger is in said second position, said padlock being disposable through said second and third holes to prevent unauthorized movement of said plunger to said first position.

7. A locking device as set forth in claim 1, wherein:

said container includes a pair of hinged lids;

said latch means are secured to a channel member fixedly secured to said pair of lids at a front portion thereof, said channel member being operative to allow said pair of lids to be opened and closed together as a unit; and said housing is mounted to a front wall of said container beneath said channel member.

8. A locking device for use on a container having at least one hinged lid movable between open and closed positions, emptying of said container being effected by raising and tilting said container to a degree sufficient to cause said at least one lid to swing open and the contents of said container to fall therefrom, said locking device comprising:

a housing, mountable to a front portion of said container, having an aperture in the upper surface;

a latch member, mountable to a front portion of said at least one lid, having a lower portion adapted to protrude into said aperture when said at least one lid is moved to its closed position;

a keeper disposed within said housing, configured to releasably engage said lower portion of said latch member upon protrusion of said lower portion into said housing through said aperture, said keeper being adapted to automatically release said lower portion of said latch member during the tilting of said container for emptying, thereby allowing said at least one lid to swing open;

a horizontally oriented plunger slidably disposed through a front wall of said housing, having a first end with at least one finger extending therefrom bearing on a portion of said keeper and a second end extending from said housing, said plunger being movable between an extended position, wherein said second end is spaced apart from said housing, and a depressed position, wherein said second end is relatively close to said housing, whereby moving said plunger from said depressed position to said extended position causes said at least one finger to disengage said keeper from said latch member; and locking means for selectively preventing the operation of said plunger.

9. A locking device as set forth in claim 8, wherein:

said lower portion of said latch member comprises a generally hook-shaped element; and said keeper comprises a pin configured for engagement with said hook-shaped element.

10. A locking device as set forth in claim 9, wherein:

said pin has first and second ends slidably disposed in laterally spaced apart slots formed within the walls of said housing, said slots providing the only means of support for said pin, said slots being oriented to maintain said pin in a generally horizontal position and to enable said pin to roll or slide out of engagement with said hook-shaped element upon tilting said container for emptying.

11. A locking device as set forth in claim 10, wherein:

said plunger has two said finger extending upwardly therefrom bearing on said pin, whereby moving said plunger from said depressed position to said extended position causes said fingers to slide or roll said pin along said slots out of engagement with said hook-shaped element.

12. A locking device as set forth in claim 8, wherein:

said plunger is slidably disposed within a horizontal tubular member extending through a front wall of said housing and fixedly secured thereto.

13. A locking device as set forth in claim 12, wherein said locking means comprise:

a first transverse hole formed through said tubular member;

a second transverse hole formed through said plunger, said second hole being aligned with said first hole when said plunger is in said depressed position; and a padlock securable through said aligned first and second holes to prevent movement of said plunger to said extended position.

14. A locking device as set forth in claim 13, further comprising:.

a third transverse hole formed through said plunger, said third plunger being aligned with said first hole in said tubular member when said plunger is in said extended position, whereby said padlock is securable through said aligned second and third holes to prevent movement of said plunger to said depressed position, thereby maintaining said locking device in an unlocked condition.

* * * * *